United States Patent [19]

Clark, Jr.

[11] 4,229,922

[45] Oct. 28, 1980

[54] WALL ASSEMBLY

[76] Inventor: John E. Clark, Jr., 735 Granvia Valmonte, Palm Springs, Calif. 92266

[21] Appl. No.: 45,188

[22] Filed: Jun. 4, 1979

[51] Int. Cl.[3] ..... E04C 1/10

[52] U.S. Cl. ..... 52/586; 52/442; 52/562; 52/712

[58] Field of Search ..... 52/585, 586, 442, 426, 52/438, 562–565

[56] References Cited

U.S. PATENT DOCUMENTS

| | | | |
|---|---|---|---|
| 791,291 | 5/1905 | Roberts | 52/442 |
| 1,962,514 | 6/1934 | MacWilliam | 52/562 |
| 2,106,177 | 1/1938 | Haltquist | 52/438 |
| 2,228,363 | 1/1941 | Pinney | 52/586 |
| 2,929,238 | 3/1960 | Kaye | 52/562 |
| 3,546,833 | 12/1970 | Perreton | 52/562 |
| 3,562,991 | 2/1971 | Kustusch | 52/564 |
| 3,788,020 | 1/1974 | Gregori | 52/426 |
| 4,034,529 | 7/1977 | Lampus | 52/426 |

FOREIGN PATENT DOCUMENTS

| | | | |
|---|---|---|---|
| 806046 | 6/1951 | Fed. Rep. of Germany | 52/585 |
| 2255810 | 11/1972 | Fed. Rep. of Germany | 52/562 |
| 989155 | 9/1951 | France | 52/564 |

*Primary Examiner*—James A. Leppink
*Assistant Examiner*—H. E. Raduazo

[57] ABSTRACT

A wall assembly comprising a plurality of building blocks, each of the building blocks have first and second coextensive and parallel wall portions interconnected by a third wall portion, each of the wall portions being provided with grooves therein, and a lattice member comprising parallel and coextensive runner members interconnected by spreader members, the grooves being adapted to receive the lattice member, the lattice member being operative to interconnect and lock together the building blocks to form a wall structure.

7 Claims, 13 Drawing Figures

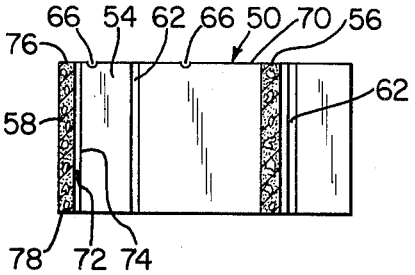
FIG. 9
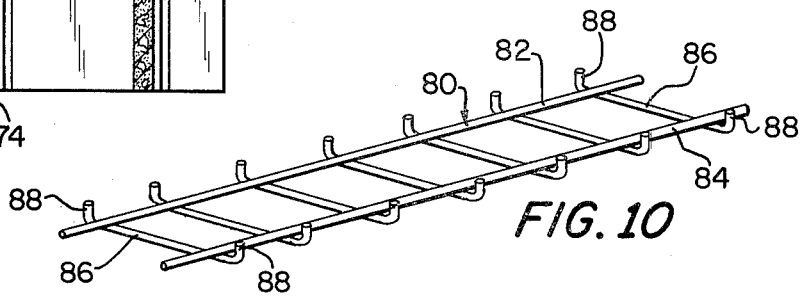
FIG. 10
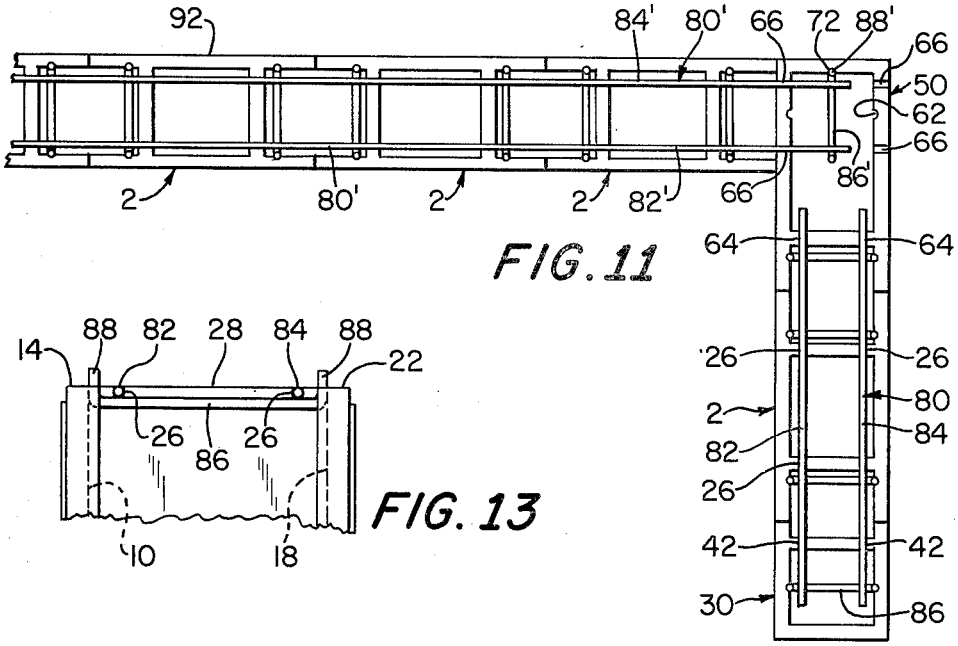
FIG. 11
FIG. 13
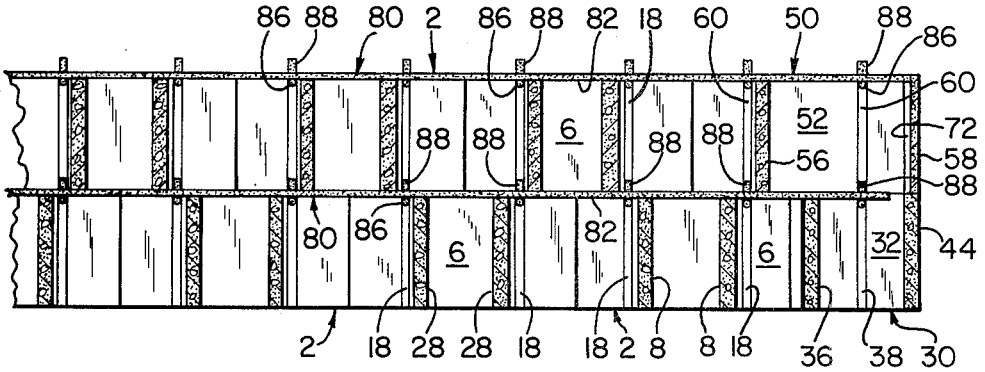
FIG. 12

WALL ASSEMBLY

BACKGROUND OF THE INVENTION

1. Field of the Invention

This invention relates to building structures and is directed more particularly to a wall assembly by which there may be constructed a wall structure without benefit of mortar, or the like.

2. Description of the Prior Art

A combination of building blocks and lattice structures is generally known. For example, U.S. Pat. No. 791,291, issued May 30, 1905 to G. J. Roberts, relates to blocks having edge configurations for interlocking engagement and also having grooves therein for receiving wires or rods which operate to retain the blocks in their desired positions. The wires or rods are preferably held by a metal frame which constitutes the outer limits of the wall, the blocks being mounted within the frame.

In U.S. Pat. No. 2,228,363, issued Jan. 14, 1941, to R. L. Pinney, there is disclosed a wall structure of preformed blocks with means for connecting the blocks together without mortar. The connecting means comprises key members of generally H-shaped cross section which operate to connect the edge of a first block to a mating edge of a second block.

U.S. Pat. No. 2,294,051, issued Aug. 25, 1942 to N. P. Sjobring shows a wall construction utilizing blocks having tongues extending therefrom, the tongues being provided with notches for receiving locking tie rods.

A. Penton, in U.S. Pat. No. 3,546,833, issued Dec. 15, 1970, discloses a wall construction assembly including a building block, an insulating insert, and a ladder-like metal reinforcing member. U.S. Pat. No. 2,929,238, issued Mar. 22, 1960 to K. H. Kaye also shows a ladder-like "joint mesh strip" for use in building block construction. In the Peneton and Kaye disclosures, it is intended that the reinforcing member be used in conjunction with mortar, cement, or the like.

There exists a need for an assembly by which wall structures, and the like, may be quickly and easily erected, without use of mortar, allowing a reduction in expense of skilled labor.

SUMMARY OF THE INVENTION

An object of the present invention is to provide a wall assembly which can be easily and quickly assembled without use of mortar, cement, or the like.

A further object of the invention is to provide such a wall assembly including preformed building blocks and a lattice member for interconnecting and locking in place such building blocks.

With the above and other objects in view, as will hereinafter appear, a feature of the present invention is the provision of a wall assembly comprising a plurality of building blocks, each of the building blocks having a first upstanding, rectangularly-shaped wall portion, a second upstanding, rectangularly-shaped wall portion parallel to and coextensive with the first wall portion, and a third upstanding wall portion interconnecting the first and second wall portions, the first wall portion having first goove means on an interior surface thereof opposed to the second wall portion, the first groove means extending from an upper edge of the first wall portion toward a lower edge of the first wall portion the second wall portion having second groove means on an interior surface opposed to the first wall portion, the second groove means extending from an upper edge of the second wall portion toward a lower edge of the second wall portion, the third wall portion having third groove means in an upper edge thereof, the third groove means extending width-wise of the third wall portion upper edge, and a lattice member comprising first and second elongated runner members disposed parallel to each other and co-extensive with each other, and spreader members, each spreader member interconnecting the runner members, the ends of the spreader members extending beyond the runner member, the spreader members being upturned at their ends to provided end portions extending substantially normal to the spreader member and extending upwardly above the runner members, the first groove means being adapted to receive the spreader end portions and the third groove means being adapted to receive the runner members, whereby the lattice member is adapted to interconnect and lock together the pluality of building blocks to form a wall structure.

The above and other features of the invention, including various novel details of construction and combinations of parts, will now be more particularly described with reference to the accompanying drawings and pointed out in the claims. It will be understood that the particular devices embodying the invention are shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent.

In the drawings:

FIG. 9 is an elevational sectional view, taken along line IX—IX of FIG. 8;

FIG. 10 is a perspective view of one form of lattice member suitable for the illustrative assembly;

FIG. 11 is a top plan view of an illustrative assembly in accordance with the invention;

FIG. 12 is an elevational sectional view of the assembly; and

FIG. 13 is an enlarged detailed elevational view of a building block and a portion of the lattice member.

DESCRIPTION OF THE PREFERRED EMBODIMENT

Figure 1:
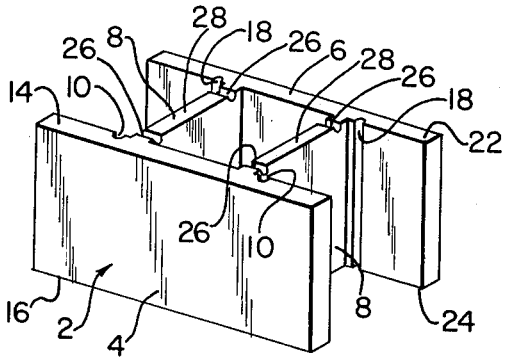
FIG. 1 is a perspective view of one form of building block suitable for the illustrative assembly.
Figure 2:
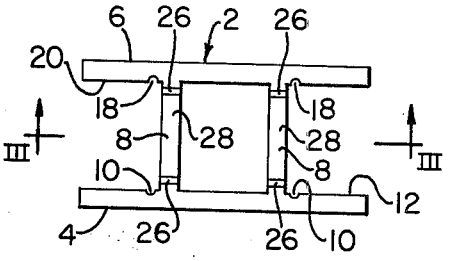
FIG. 2 is a top plan view of the block of FIG. 1.
Figure 3:
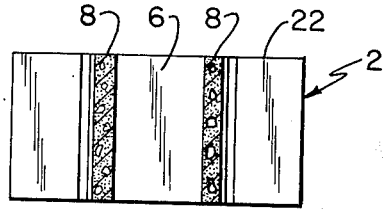
FIG. 3 is an elevational section view, taken along line III—III of FIG. 2.

Referring to the drawings, and particularly FIGS. 1-3, it will be seen that an illustrative building block comprises a preferred block 2 of concrete, cinder block, plastic, wood, or other suitable material. The block 2 is provided with a first upstanding rectangularly-shaped wall portion 4, a second upstanding rectangularly-shaped wall portion 6 disposed parallel to, and coextensive with, the first wall portion 4, and a third upstanding wall portion, or web, 8 interconnecting the first and second wall portions. In the block 2, there are provided two webs 8 interconnecting the wall portions 4, 6.

The first wall portion 4 is provided with first groove means 10 on an interior surface thereof 12 opposed to the second wall portion 6. The first groove means in the block 2 includes two grooves 10 extending from an upper edge 14 of the first wall portion 4 to a lower edge 16 of the first wall portion. In like manner, the second wall portion 6 is provided with second groove means 18 on an interior surface thereof 20, opposed to the first wall portion. The second groove means comprises a pair of grooves 18 opposed to the grooves 10 and extending from an upper edge 22 of the second wall portion to a lower edge 24 of the second wall portion.

The third wall portions, or webs, 9 are provided with third groove means 26 in an upper edge thereof 28, the third groove means including pairs of grooves 26 extending width-wise of the third wall portion upper edge 28.

In a preferred embodiment, the block 2 would have a length of sixteen inches, a width of eight inches and a height of eight inches or, alternatively, four inches.

Figure 4:
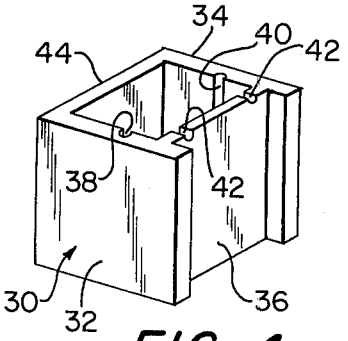
FIG. 4 is a perspective view of another form of building block.
Figure 5:
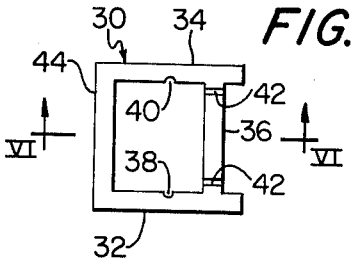
FIG. 5 is a top plan view of the block of FIG. 4.
Figure 6:
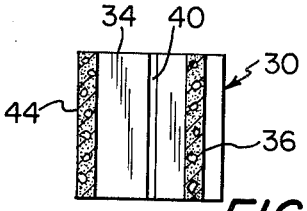
FIG. 6 is an elevational sectional view, taken along line VI—VI of FIG. 5.

In FIGS. 4–6, there is shown an end block 30 having first, second and third wall portions 32, 34, 36 arranged substantially as described relative to the block 2 of FIG. 1. The end block 30 is preferably half the length of the block 2 and therefore is provided with a single web 36. First, second and third groove means 38, 40, 42 are provided in substantially the same fashion as the groove means of the block 2, except that with the shorter length, the block 30 is provided with a first groove means comprising a single groove 38, a second groove means comprising a single groove 40, and a third groove means comprising a pair of grooves 42. The block 30 is provided with an end wall 44 interconnecting ends of the first and second wall portions.

Figure 8:
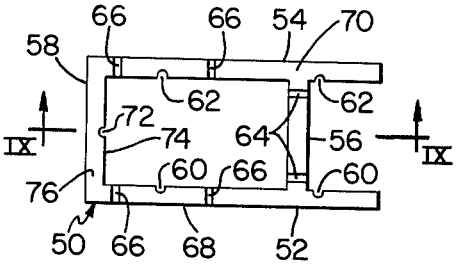
FIG. 8 is a top plan view of the block of FIG. 7.
Figure 7:
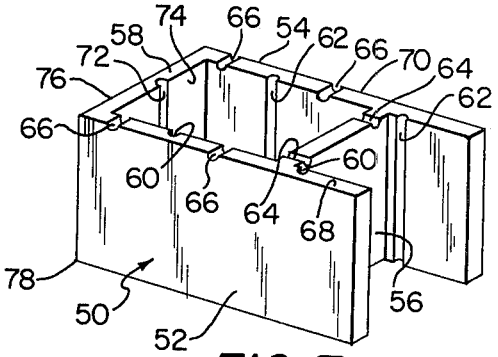
FIG. 7 is a perspective view of antoerh form of building blocks.

In FIGS. 7–9, there is shown an end, or corner, block 50 having first, second, third and end wall portions 52, 54, 56, 58, substantially as described hereinabove with respect to the end block 30. The first and second wall portions 52, 54 are respectively provided with first and second groove means 60, 62 disposed similarly to the first and second groove means of the block 2. The third wall portion 56 is similar to the third wall portion 36 of the end block 30 and is provided with third groove means 42. The end wall 58 of the block 50 is disposed similarly to the end wall 44 of the end block 30.

However, in addition to the features previously discussed with respect to the blocks 2 and 30, the corner block 50 is provided with a fourth groove means 66. The fourth groove means 66 includes a pair of grooves 66 on an upper edge 68 of the first wall portion 52 and an aligned pair of grooves 66 on an upper edge 70 of the second wall portion 54. The corner block 50 is further provided with a fifth groove means 72 comprising a single groove on an interior surface 74 of the end wall portion 58 and extending from an upper edge 76 of the end wall portion to a lower edge 78 thereof. The corner block 50 is preferably of outside dimensions substantially equal to those of the block 2.

Referring to FIG. 10, there is shown an illustrative lattice member 80, including first and second elongated runner members 82, 84 disposed parallel to each other and coextensive with each other. Spreader members 86 are fixed to and interconnect the funner members 82, 84 at spaced intervals. Ends of the spreader members 86 extend beyond the runner members and are upturned to provide end portions 88 extending substantially normal to the spreader members. The spreader members are connected to the runner members at the underside of the runner members, as viewed in FIG. 10, and the end portions 88 of the spreader members extend upwardly above the runner members. The lattice member is preferably constructed of steel rods.

Referring to FIG. 13, it will be seen that the first and second groove means 10, 18 are adapted to receive the spreader end portions 88, and the third groove means 26 are adapted to receive the runner members 82, 84. The end portions 88 project upwardly beyond the upper edges 14, 22, 28 of the wall portions of the block and are adapted to engage the first and second groove means of a block (now shown) on top of the block shown in FIG. 13.

The corner block 50 fourth groove means 66 are adapted to receive the lattice member runner members 80, 82 width-wise of the block, and the fifth groove means 72 are adapted to receive spreader member end portions 88. Thus, the corner block 50 is adapted to receive lattice members lengthwise and width-wise.

The use of the assembly is best illustrated in FIGS. 11 and 12. Referring particularly to FIG. 11, an illustrative wall section 90 includes a corner block 50, a regular or line block 2, and an end block 30. A lattice member 80 locks the blocks together, the runner members 82, 84 of the lattice member being received in the groove means 26, 42 and 64, and the spreader member end portions 88 being received in the groove means 10 and 18, 38 and 40, and 60 and 62. As shown in FIG. 12, the upstanding end portions 88 additionally engage the groove means 10, 18, 38, 40, 60 and 62 of the line of blocks above the line in which rests the lattice member.

Turning again to FIG. 11, a second wall section 92 comprises a series of line blocks 2, an end line block abutting the corner block 50. A second lattice member $80^1$ is disposed width-wise of the corner block 50, runner members $82^1$, $84^1$ being accepted in the groove means 66 and an end portion $88^1$ of a spreader member $86^1$ being accepted by the groove means 72.

In practice, the corner block 50 may be used as an ordinary end block, taking the place of the block 30 if the additional length of the block 50 is desired.

Thus, without use of mortar, cement, or the like, wall sections may be erected and subsequently dismounted. The assembly is particularly useful in the construction of temporary quarters, garden walls, decorative walls, traffic detour walls, and like walls or partitions which might be subject to dismantlement or movement.

It is to be understood that the present invention is by no means limited to the particular construction herein disclosed and/or shown in the drawings, but also comprises any modifications or equivalents within the scope of the disclosure.

For example, it will be apparent that the vertical grooves, such as grooves 10, 18 need not extend from top to bottom of the block, inasmuch as only a portion of the grooves receive the lattice member. However, for ease of manufacture, the grooves may extend, as shown, from the upper edge to the lower edge of the block.

Having thus described my invention what I claim as new and desire to secure by Letters Patent of the United States is:

1. A wall assembly comprising a plurality of building blocks, each of said building blocks have a first upstanding rectangularly-shaped wall portion, a second upstanding rectangularly-shaped wall portion parallel to and coextensive with said first wall portion, and a third interconnecting said first and second wall portions, said first wall portion having first groove means on an interior surface thereof opposed to said second wall portion, said first groove means extending from an upper edge of said first wall portion toward a lower edge of said first wall portion, said second wall portion having second groove means on an interior surface thereof opposed to said first wall portion, said second groove means extending from an upper edge of said second wall portion toward a lower edge of said second wall portion, said third wall portion having third groove means in an upper edge thereof, said third groove means extending width-wise of said third wall portion upper edge, and a lattice member comprising first and second elongated runner members disposed parallel to each other and generally coextensive with each other, and spreader members, each spreader member interconnecting said runner members, the ends of said spreader members extending beyond said runner members, said spreader members being upturned at their ends to provide end portions extending substantially normal to said spreader member and extending upwardly above said runner members, said first and second groove means being adapted to receive said spreader and portions and said third groove means being adapted to receive said runner members, whereby said lattice member is adapted to interconnect and lock together said plurality of building blocks to form a wall structure.

2. The invention in accordance with claim 1 and including an end wall interconnecting ends of said block.

3. The invention in accordance with claim 2 in which said first and second wall portions are provided with fourth groove means extending width-wise of the respective upper edges thereof and adapted to receive said runner members of said lattice member.

4. The invention in accordance with claim 3 in which said end wall is provided with fifth groove means on an interior surface thereof, said groove means extending from an upper edge of said end wall toward a lower edge of said end wall and being adapted to receive one of said end portions.

5. The invention in accordance with claim 1 in which said first groove means comprises a pair of parallel grooves and said second groove means comprises a pair of parallel grooves.

6. The invention in accordance with claim 1 in which said third groove means comprises a pair of parallel grooves in said upper edge of said third wall portion.

7. The invention in accordance with claim 1 in which said spreader members are fixed to an underside of said runner members and said end portions extend upwardly normal to said runner members.

* * * * *